US005326950A

United States Patent [19]

Lammers et al.

[11] Patent Number: 5,326,950

[45] Date of Patent: Jul. 5, 1994

[54] DRIVE MECHANISM FOR AN ELECTRIC SWITCH, IN PARTICULAR A CIRCUIT BREAKER OR POWER SWITCH

[75] Inventors: Arend J. W. Lammers, Hengelo; Gerhardus L. Nitert, Enter; Gerrit W. Hendriks, Hellendoorn, all of Netherlands

[73] Assignee: Holec Systemen En Componenten B.V., Hengelo, Netherlands

[21] Appl. No.: 909,189

[22] Filed: Jul. 6, 1992

[30] Foreign Application Priority Data

Jul. 3, 1991 [NL] Netherlands ..... 9101162

[51] Int. Cl.[5] ..... H01H 3/46

[52] U.S. Cl. ..... 200/469; 200/440; 200/444

[58] Field of Search ..... 200/469, 468, 457, 440, 200/443, 444, 449

[56] References Cited

U.S. PATENT DOCUMENTS 1,077,380 11/1913 Wellman ..... 200/469 X 3,467,800 9/1969 Barr ..... 200/469

FOREIGN PATENT DOCUMENTS 2015624 10/1971 Fed. Rep. of Germany ..... 200/440

*Primary Examiner*—Renee S. Luebke

*Attorney, Agent, or Firm*—Watson, Cole, Grindle & Watson

[57] ABSTRACT

A drive mechanism for a circuit breaker or power switch made up of at least one switching unit and comprising a biasing mechanism which can act upon the switching unit, with actuating mechanism for biasing the biasing mechanism, drive mechanism for driving the switching unit under the influence of the energy stored in the biasing mechanism, and mechanism for resetting the switching unit from the driven state. A coupling mechanism in the form of a movement-direction-dependent carrier mechanism is provided whereby the biasing mechanism is brought in its biased state into engagement with the drive mechanism for driving the switching unit and in the driven state of the switching unit the engagement of the biasing mechanism and the drive mechanism is released for resetting the switching unit without operation of the actuating mechanism, and the biasing mechanism and the drive mechanism act upon each other only in the direction of movement opposite to the biasing direction. To improve the "hammer" effect during separation of the contacts of the switching unit, the drive mechanism is made mechanically more rigid near the action point with the switching unit through a selective mass increase.

25 Claims, 6 Drawing Sheets

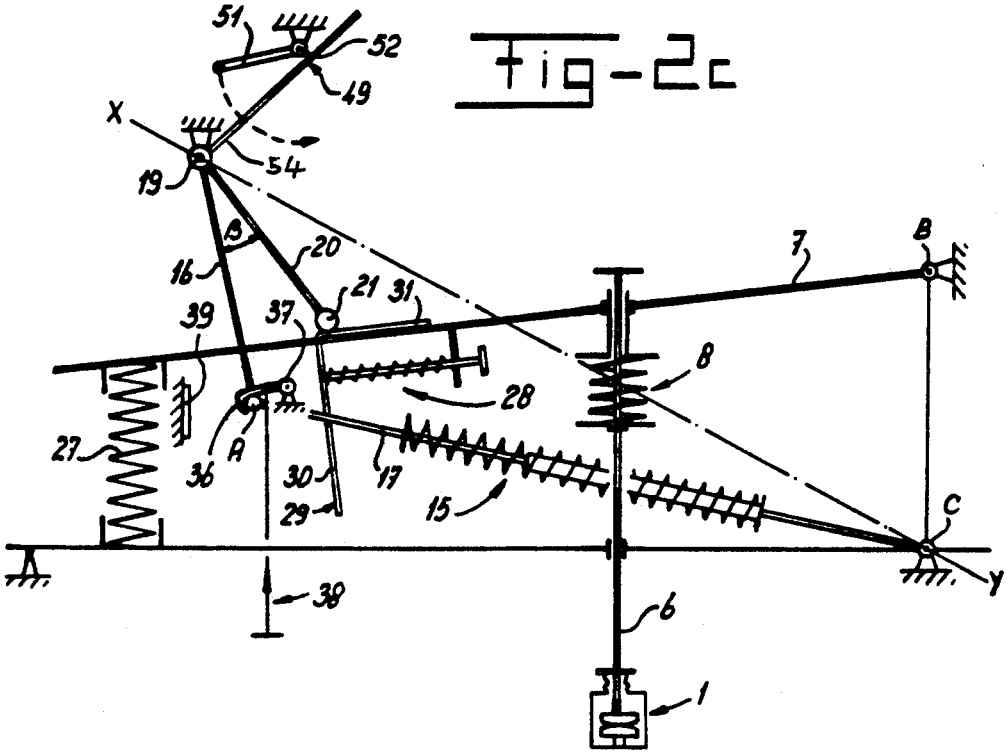
Fig-2c
Fig-3
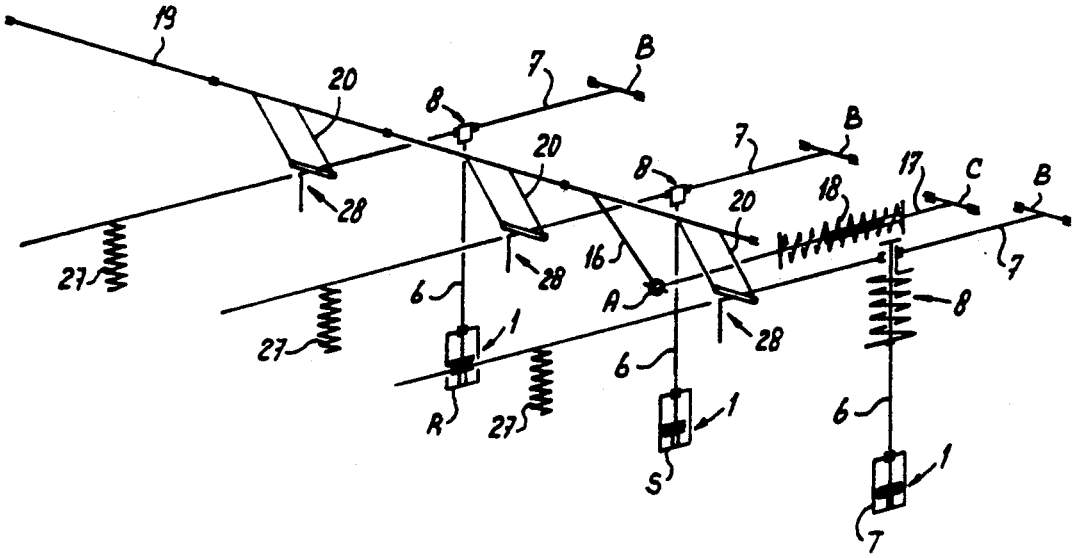

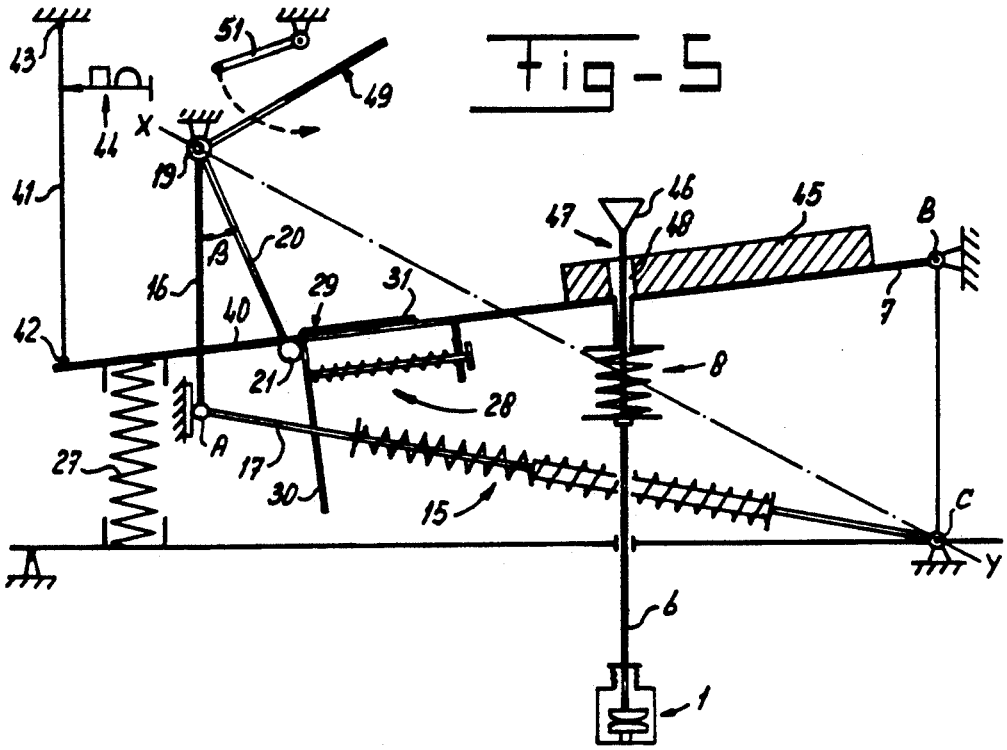
Fig-5
Fig-6a
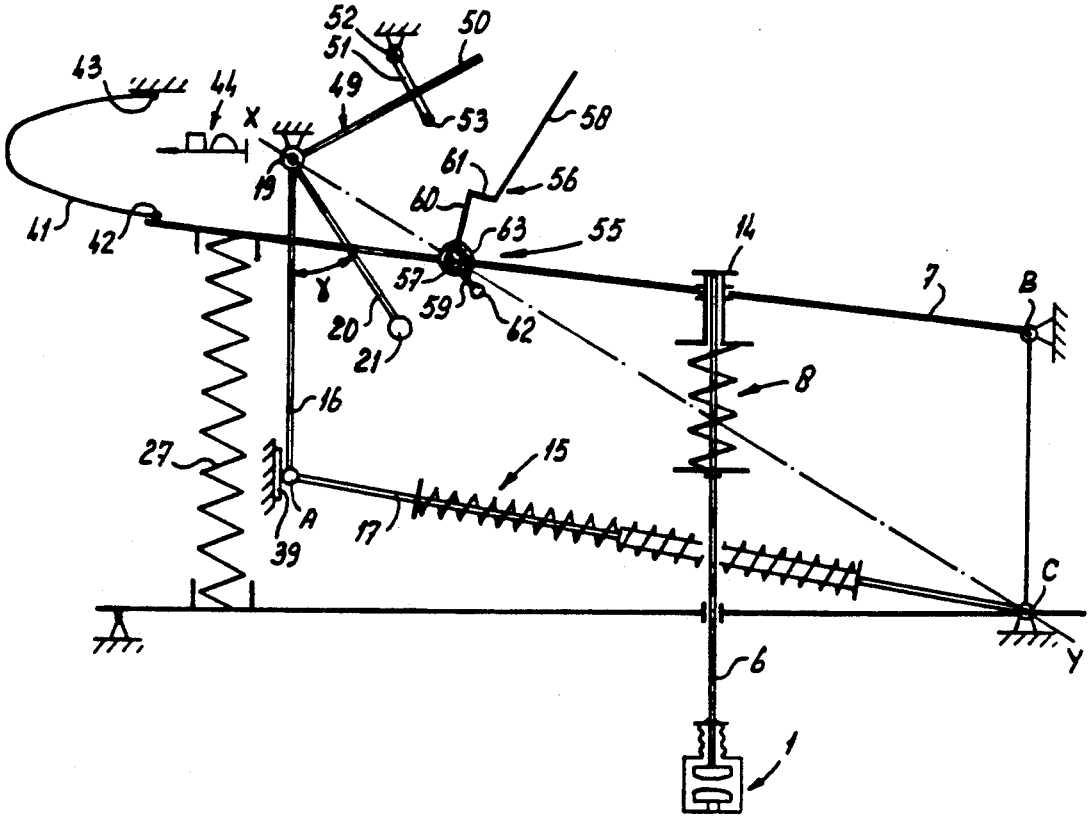

50
53
49
52
56
58
43
X
γ
20
21
42
44
19
40
61
55
41
63
14
7
B
40
57
62
16
8
27
A
17
15
39
C
Y
6
1

51
52
53
50
44
43
X
49
19
56
58
γ
41
20
61
55
14
7
B
16
21
60
63
42
40
57
62
8
15
27
A
39
17
C
Y
6
1

DRIVE MECHANISM FOR AN ELECTRIC SWITCH, IN PARTICULAR A CIRCUIT BREAKER OR POWER SWITCH

BACKGROUND OF THE INVENTION

The invention relates to a drive mechanism for an electric switch made up of at least one switching unit, in particular a circuit breaker or power switch, comprising a tensioning mechanism in the form of a transition point or overturn mechanism which can act upon the at least one switching unit, actuating means for tensioning the tensioning mechanism, drive means for driving the at least one switching unit under the influence of the energy stored in the tensioning mechanism, means for resetting the at least one switching unit from the driven state, and a coupling mechanism for bringing the tensioning mechanism in its tensioned state into engagement with the drive means, for driving the at least one switching unit, and for releasing the engagement of the tensioning mechanism and the drive means when the at least one switching unit is in the driven state.

A drive mechanism with a tensioning mechanism in the form of a transition point or overturn mechanism is known from Dutch Patent Application 8803018, in which the tensioning mechanism for driving the switching unit moves past its transition point or dead centre, thus in the same direction as that in which the tensioning mechanism is tensioned. When the switching unit is being driven or switched on, the drive means remain in engagement with the tensioning mechanism. For switching off the switching unit, this engagement first has to be released by means of the actuating means.

Although the switching unit can be switched on and off at a specific speed and in a reproducible manner with this known device, it is not possible when, for example, switched to a short-circuit current, to switch off the switching unit directly, i.e. without operating the actuating means.

A switch having a drive mechanism with a tensioning mechanism in the form of a transition point or overturn mechanism is also known from U.S. Pat. No. 4,336,520, which switch is also provided with a coupling mechanism. Said coupling mechanism ensures that the drive means for driving the switching unit are brought into engagement with the tensioning mechanism when it is tensioned, and that when the switching unit is being driven the engagement of the tensioning mechanism and the drive means is released.

During driving of the switching unit the tensioning mechanism, as in the case of the abovementioned Dutch Patent Application, moves past its transition point, thus in the same direction as that in which the tensioning mechanism is tensioned. For switching on the switch again after it has been switched off, such a tensioning mechanism must first be moved through the actuating means into a rest position suitable for switching on the switch. For switching on the switch, the maximum storage energy, i.e. the energy required for moving the tensioning mechanism past its transition point or dead centre, must always be supplied to the tensioning mechanism by the actuating means.

French Patent 808,888 also discloses a drive mechanism for an electric switch, provided with a tensioning mechanism in the form of a transition point or overturn mechanism, in which the drive means do not remain in engagement with the tensioning mechanism when the switching unit is being driven or is switched on. Here too, for switching on the switch again, the tensioning mechanism must be reset in a stable rest position by means of the actuating means, while the operation of the drive mechanism is again based on the tensioning mechanism moving past the transition point or dead centre.

SUMMARY OF THE INVENTION

The object of the invention is to provide an improved drive mechanism, such that the switching unit can be switched on again directly without the tensioning mechanism first having to be reset in a particular rest position by the actuating means.

This is achieved according to the invention in that the coupling mechanism is designed to tension the tensioning mechanism by the actuating means from a rest position to before its transition point or dead centre, and the drive means and the coupling mechanism form a movement-direction-dependent carrier mechanism, such that the tensioning mechanism and the drive means act upon each other only in the direction of movement opposite to the tensioning direction, for driving the at least one switching unit.

Through the use of a movement-dependent carrier mechanism according to the invention, it is sufficient to have a transition point or overturn mechanism which need be tensioned from the rest position only to before its transition point or dead centre, in order to supply the driving force for driving the at least one switching unit. Since the tensioning mechanism moves in the opposite direction to the tensioning direction during driving of the switching unit, it is also no longer necessary to move the tensioning mechanism into its rest position by means of the actuating means in order to switch on the switching unit again.

It will be clear that in the case of the drive mechanism according to the invention the energy for tensioning the tensioning mechanism is lower than the maximum storage energy of the tensioning mechanism, i.e. the energy required for moving the tensioning mechanism past its transition point or dead centre. In addition to this energy advantage, the drive mechanism according to the invention can also switch more quickly than the known drive mechanism, because the transition point or overturn mechanism used need be tensioned only to before its transition point or dead centre, and from this position can drive the switching unit directly, without first having to pass through its transition point or dead centre, as in the case of the known drive mechanism.

In one embodiment of the invention, the tensioning mechanism can consequently be a toggle mechanism, i.e. without transition capability past the dead centre.

British Patent Application 2,118,780 discloses a drive mechanism for an electric switch, provided with a tensioning mechanism in the form of a spring connected to a rotary arm and drive means for driving the switching unit of the switch under the influence of the energy stored in the tensioning mechanism through tensioning thereof. However, this is not a tensioning mechanism in the form of a transition point or toggle mechanism according to the invention.

In a first preferred embodiment of the drive mechanism according to the invention, the drive means comprise at least one switching arm acting on the at least one switching unit and a driving arm coupled to the transition point or toggle mechanism, while the coupling mechanism is made up of a coupling arm fixed to the switching arm and rotatable in the plane of the switching arm and the driving arm, and provided with a first and second stop and spring means for moving the coupling arm into an initial position, the first stop is arranged such that, on tensioning of the transition point or toggle mechanism from the rest position by the actuating means, the driving arm acts upon the first stop, as a result of which the coupling arm is rotated from its initial position relative to the switching arm and loading the spring means, and that in the vicinity of the transition point or dead centre of the transition point or toggle mechanism the driving arm moves past the first stop of the coupling arm and acts upon the second stop of spring loaded the coupling arm, which second stop is arranged such that on the return of the transition point or toggle mechanism in the direction towards the rest position, the switching arm is driven by means of the driving arm acting on the second stop of the coupling arm.

Such a coupling arm takes up relatively little space and can be made sufficiently robust to withstand the forces exerted on it under the influence of the tensioning mechanism for driving the switching arm during the rated service life of the mechanism.

In a practical embodiment, the coupling arm is essentially L-shaped, with a long leg extending at one side of the switching arm in a direction opposite to the direction in which the switching unit is driven, and a shorter leg extending at the other side of the switching arm, for limiting in the initial position the rotation of the coupling arm caused by the spring means, the longer leg being provided with a step, and the part of the longer leg extending from the point where the coupling arm is fixed to the switching arm till the step forming the first stop, while the step lying at right angles thereto forms the second stop of the coupling arm.

In yet another embodiment of the drive mechanism according to the invention, the drive means comprise at least one switching arm acting on the at least one switching unit and a driving arm coupled to the transition point or toggle mechanism, while the coupling mechanism is made up of a slide which is movable in lengthwise direction of the switching arm, and is provided with a first and second stop and spring means for moving the slide into an initial position, the first stop is arranged such that on tensioning of the transition point or toggle mechanism from its rest position by the actuating means, the driving arm acts upon the first stop, as a result of which the slide is moved from its initial position in the lengthwise direction of the switching arm and loading the spring means, and that in the vicinity of the transition point or dead centre of the transition point or toggle mechanism the driving arm moves past the first stop of the slide, as a result of which it returns to its initial position under the influence of the spring force of the spring means, while the driving arm acts upon the second stop of the slide, which second stop is arranged such that on the return of the transition point or toggle mechanism in the direction towards the rest position, the switching arm is driven by means of the driving arm acting on the second stop of the slide.

Such a carrier mechanism in the form of a spring-loaded slide can also be made sufficiently robust in construction to withstand the forces exerted on it under the influence of the tensioning mechanism for driving the switching arm.

In a practical embodiment, the slide is made up of a first leg extending essentially at right angles to the switching arm in the driving direction of the switching unit, and a second leg extending parallel to the switching arm, with blocking means acting on the slide, for limiting in the initial position the movement of the slide caused by the spring means, while the first leg forms the first stop and the second leg forms the second stop of the slide.

In an embodiment of the drive mechanism according to the invention in which the construction takes up little space, the transition point or toggle mechanism, the driving arm coupled thereto and the switching arm lie in one plane, while the switching arm has an aperture in which the transition point or toggle mechanism and the driving arm can move.

In yet another embodiment of the drive mechanism according to the invention, provision is made for locking means acting upon the transition point or toggle mechanism, for locking the transition point or toggle mechanism before the rest position when the switching arm is being driven, while the driving arm remains in contact with the second stop of the coupling mechanism, and through releasing the locking the driving arm can move past the second stop of the coupling mechanism, and under the influence of a resetting force acting upon it the switching arm can be reset in a direction opposite to the driving direction.

This manner of locking is particularly suitable for use in the case of a drive mechanism provided with a single tensioning mechanism by which several individual switching units are driven through corresponding drive means, for example in the form of a switching arm and a driving arm coupled to the transition point or toggle mechanism. The locking means in their simplest form can comprise a switch-off pawl which, for example, acts upon the bending or movable pivot point of the transition point or toggle mechanism.

In yet another embodiment of the drive mechanism according to the invention, provision is made for locking means acting on the switching arm, for locking the switching arm in the driven state, in which the transition point or toggle mechanism is in the rest position and the driving arm has been moved past the second stop of the coupling arm, and where through releasing the locking, under the influence of the resetting force acting thereon, the switching arm can be reset in a direction opposite to the driving direction.

In this embodiment of the invention the transition point or toggle mechanism in the driven state can be moved automatically until it is in the rest position, and the locking means act directly upon the switching arm. This has the advantage that during resetting of the switching unit the switching arm can be moved directly under the influence of the resetting force acting thereon, without the action of the driving arm upon the second stop of the slide having to be released first.

With this method of locking it is also possible to have a so-called Open-Close-Open (OCO) switching cycle, which is necessary particularly in the case of power switches, for example when connecting to a short-circuit current. The contacts must then be capable of being opened directly, without the necessity for human intervention. Such an OCO cycle is not possible in the case of an electric switch equipped with a drive mechanism known from the abovementioned Dutch patent application. The tensioning mechanism according to the invention can also already be "pretensioned", so that after opening of the contacts a rapid closure can follow if desired.

Although in this case also a locking pawl acting upon the switching arm will suffice, in one embodiment of the invention provision is made for locking means comprising a leaf spring extending essentially at right angles to the switching arm, which spring is firmly supported at one end and acts upon the switching arm with its other end. When not deflected, the leaf spring ensures locking of the switching arm, while the locking can be removed very rapidly at a stroke by causing the leaf spring to deflect. A further increase in the switching speed of the drive mechanism is achieved by means of this leaf spring locking.

The locking means can be operated either by hand or by electromagnetic and/or electrothermal means, for selective resetting of switching units, for example timed. The embodiment in which the locking means act directly upon the switching arm is particularly suitable for selective switching off of switching units in a polyphase power switch, in order to prevent so-called virtual chopping which can occur with the use of vacuum switches in particular.

In the case of the drive mechanism known from the abovementioned Dutch patent application the at least one switching unit can be switched on by rotating a common shaft of the actuating means and the drive means in one direction, and in the other direction for switching off the switching unit. In practice, however, it is desirable for ease of use and clarity to provide actuating means, for example in the form of a control wheel, which need be rotated only in one direction.

Since in the drive mechanism according to the invention the switching unit need not be reset by means of the actuating means, the envisaged ease of use and clarity is achieved in yet a further embodiment of the invention with actuating means composed of a pivoting tensioning arm coupled to the transition point or toggle mechanism, and provided with a stop and a rotatably mounted control arm which can act upon said stop, while for tensioning of the transition point or toggle mechanism the control arm can act upon the stop of the tensioning arm, and in the vicinity of the transition point or dead centre of the transition point or toggle mechanism the control arm can move past the stop of the tensioning arm, such that the transition point or toggle mechanism can move from its tensioned position in the direction of its rest position. The control arm can be provided with a control wheel if desired.

In a design which takes up little space, the tensioning arm has an aperture in which the control arm can move, and the stop is formed by the free end of the tensioning arm extending from said aperture.

For resetting of the driven switching unit, as in the case of the known drive mechanism, use can be made of mechanical springs acting upon the switching arm. In order to be able to separate any stucked or welded switch contacts, it is necessary to reset the switching unit at a stroke.

For this purpose, the invention also provides a hammer mechanism, for use with a drive mechanism for an electric switch provided with at least one switching unit, comprising a switching arm for driving the at least one switching unit, in which from the driven position the switching arm can act upon a resetting stop for resetting the at least one switching unit only after travelling a certain distance, characterised in that the mass of the switching arm is increased in the vicinity of the action point of the switching arm and the resetting stop.

The impact or "hammer" effect is obtained through the fact that the switching arm by travelling a certain distance already has a certain speed during its resetting before it acts upon the resetting stop. In order to transfer the collision energy to the switching unit as effectively as possible during the collision of the switching arm and the resetting stop, the switching arm must be rigid enough, so that there is little or no damping of the collision energy through deformation of the switching arm. In order to achieve this, the mass of the switching arm is increased in the vicinity of the engagement or action point of the switching arm and the resetting stop.

The concentration of mass in the action point of the switching arm and the resetting stop has the advantage that the remainder of the switching arm can be kept as light as possible in construction without any significant effect on its rigidity, in order to ensure that the driving speed of the switching unit is adversely affected as little as possible.

In an embodiment of the hammer mechanism according to the invention, the resetting stop is in the form of a block with an approximately V-shaped cross-section, of which the tapering end forms a linear engagement with the switching arm.

A definite "hammer position" is achieved by means of such a linear engagement of the resetting stop and the switching arm, irrespective of the relative position of the (rotary) switching arm.

In order to improve the hammer effect further, in one embodiment of the drive mechanism the switching arm is provided with an anvil element at the side where it can act upon the resetting stop, for increasing the mass of the switching arm. Hardening this anvil element at the action point with the resetting stop ensures a further improvement of the hammer effect, i.e. less damping of the collision energy. It has been found that the hammer or impact effect can be improved by a factor of 3 with a switching arm designed in this way.

In a further embodiment of the invention, the switching arm can act by means of a linking overrun coupling upon a switching rod coupled to at least one switching unit for driving it, while the resetting stop is connected to the switching rod and the linking overrun coupling comprises a contact force spring connected to the switching rod, such that the switching arm is a certain distance from the resetting stop when the switching rod is being driven, while the switching arm and the resetting stop act upon each other along a line when resetting the at least one switching unit.

It will be clear that the material of the driving rod must also be as rigid as possible, while its length must remain limited, in order to keep its spring action as low as possible. The length of the driving rod is, however, determined by the maximum surge voltage for which a switch must be suitable.

For a person skilled in the art it will be clear that this improved design of the switching arm and the switching rod can be used in electric circuit breakers or power switches provided with any desired drive mechanism having resetting means which do not act upon the switch contacts for resetting or opening them until a certain distance has been travelled.

The invention also relates to a single-phase or polyphase electric circuit breaker or power switch provided with a drive mechanism of the type discussed above.

The invention is explained in greater detail below with reference to the appended figures of different embodiments of the drive mechanism according to the invention, compared with a known drive mechanism.

BRIEF DESCRIPTION OF THE DRAWINGS

FIGS. 2*a*, 2*b* and 2*c* show schematically in different stages the principle of the drive mechanism in an embodiment according to the invention.

FIG. 3 shows in perspective a cut-away schematic view of a three-phase switch in which the drive mechanism according to FIGS. 2*a*, 2*b* and 2*c* is incorporated.

FIG. 5 shows schematically an embodiment of the drive mechanism according to the invention with improved "hammer stroke" effect.

FIGS. 6*a*, 6*b* and 6*c* show schematically in different stages the principle of the drive mechanism in the preferred embodiment according to the invention.

DETAILED DESCRIPTION OF THE EMBODIMENTS

Similar parts or parts with a similar function are indicated by the same reference number.

Figure 1A:
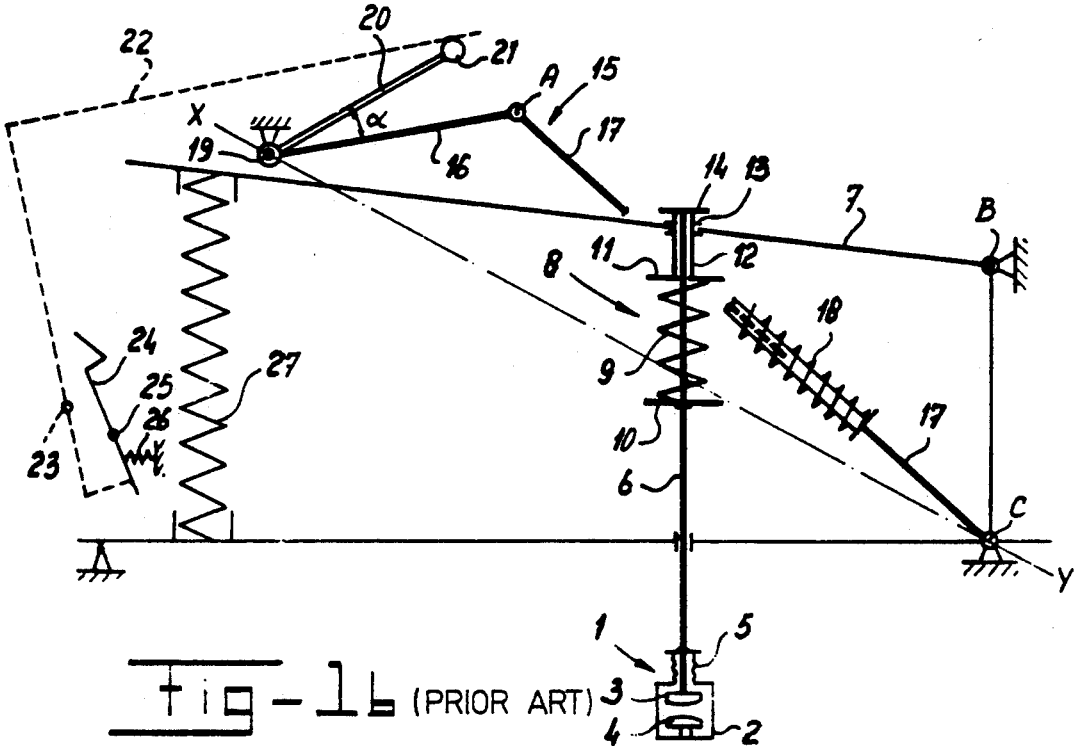
Fig-1a (PRIOR ART)
FIGS. 1*a* and 1*b* show schematically, with an open switching unit and with a closed switching unit respectively, the principle of the drive mechanism known from Dutch Patent Application 8803018.
Figure 1B:
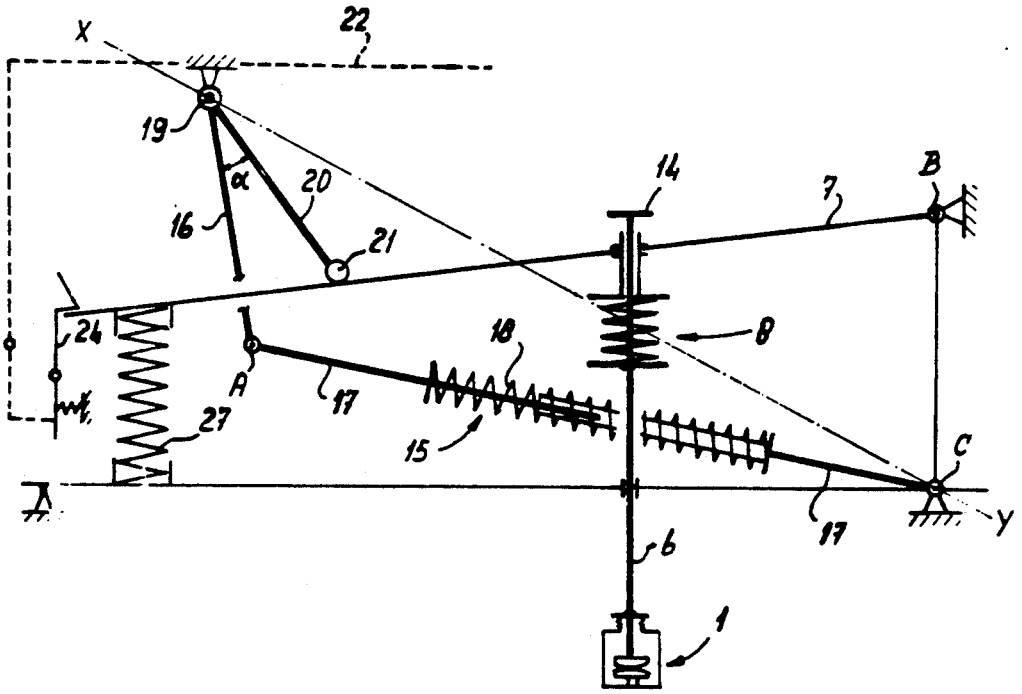
Fig-1b (PRIOR ART)

FIGS. 1*a* and 1*b* show schematically an embodiment of the drive mechanism according to Dutch Patent Application 8803018, which is incorporated by reference.

The drive mechanism shown acts upon the switching unit 1, which is shown schematically as a vacuum switch, provided with a housing 2, with a fixed contact 4 and a movable contact 3. The housing 2 has a bellows 5, which achieves a leak-free passage to a switching rod 6 connected to the movable contact 3. The switching unit 1 can be driven by means of the switching rod 6 for opening or closing of the contacts 3, 4.

The drive mechanism is made up of a switching arm 7, which is pivoted by its one end in the point B, and a linking overrun coupling 8, comprising a contact force compression spring 9 which acts with its one end 10 upon the switching rod 6, and is coupled with its other end 11, by means of a hinged connection 13 to the switching arm 7, to a bush 12 which can be slid over the switching rod 6. In the position of the drive mechanism shown in FIG. 1*a* the bush 12 is resting against a resetting stop 14 of the switching rod 6.

The tensioning mechanism 15 is formed by a transition point or overturn mechanism comprising an arm 16, one end A of which is hingedly connected to an end of a telescopic rod 17 provided with a spring 18, which telescopic rod 17 is hinged by its other end in the point C to a fixed part of a frame or a housing in which the switching unit 1 is mounted. The other end of the arm 16 is firmly fixed to a rotatably mounted actuating shaft 19. A driving arm 20 is also fixed to the actuating shaft 19, displaced through an angle $\alpha$ relative to the arm 16 of the transition point mechanism. In the position shown in FIG. 1*a* the free end 21 of the driving arm 20 acts upon an unlocking lever 22, shown by dashed lines, which can pivot about a fixed point 23 and acts upon a locking pawl 24, which is fitted so that it pivots about a fixed point 25, and on which a spring 26 acts, as shown. This known drive mechanism operates as follows.

When the actuating shaft 19 is turned in the clockwise direction, the arm 16 of the tensioning mechanism 15, shown in FIG. 1*a*, will swing down until the point A comes to rest on the imaginary connecting line X-Y between the actuating shaft 19 and the pivot point C. In this situation the spring 18 is tensioned to its maximum, so that on further rotation of the actuating shaft 19 the spring 18 is capable of forcing the actuating shaft 19 by means of the arm 16 to the position shown in FIG. 1*b*. On passing the connecting line X-Y, the transition point or dead centre of the mechanism has been passed. The driving arm 20 also swings down during rotation of the actuating shaft 19 and touches the switching arm 7 with its end 21. The angle $\alpha$ between the driving arm 20 and the arm 16 of the transition point mechanism 15 is selected such that the end 21 of the driving arm 20 touches the switching arm 7 after the transition point or the line X-Y has been passed.

The movement of the switching arm 7 under the influence of the driving arm 20 acting thereon is transmitted by means of the contact force compression spring 9 to the switching rod 6, which is driven in the direction for closing of the contacts 3, 4 of the switching unit 1, as shown in FIG. 1*b*. Through swinging of the driving arm 20, the unlocking lever 22 comes under the influence of the spring 26 into the position shown in FIG. 1*b*, in which the locking pawl 24 can act upon the free end of the switching arm 7 for locking it.

For resetting of the drive mechanism, i.e. opening the contacts 3, 4 of the switching unit 1, it is necessary to move the driving arm 20 into the position shown in FIG. 1*a* by turning the actuating shaft 19 anticlockwise. For this, the tensioning mechanism 15 has to be tensioned to its maximum tensioning or storage energy, i.e. in the position in which the point A lies on the line X-Y. After passing of the transition point, the driving arm 20 again assumes a stable position, in which the end 21 operates the unlocking lever 22, by means of which the locking of the switching arm 7 by the locking pawl 24 is released and the switching arm 7 strikes against the resetting stop 14 under the influence of the resetting force of the contact force compression spring 9. If desired, a further resetting force in the form of a compression spring 27 can be provided, and acts upon the free end of the switching arm 7, as shown. The purpose of the resetting of the switching rod 6 is to separate any contacts stucked or welded together, which is a known problem for a person skilled in the art.

Since in the case of the drive mechanism known from the abovementioned Dutch patent application the tensioning mechanism 15, or the transition point or overturn mechanism, remains in engagement with the switching rod 6 through the driving arm 20, the switching arm 7 and the linking overrun coupling 8, no switching off of the switching unit 1 can take place without turning of the actuating shaft 19. This makes this drive mechanism unsuitable for use in an electric power switch, which has to meet the requirement that when connected to a fault current, such as a short-circuit current, said fault current, for example in the case of an alternating current, must be capable of being switched off within a few cycles. The resetting of the switching unit 1 by means of the actuating shaft 19 in fact requires at least the human reaction time, and will consequently be greater than at least 0.5 sec. (25 cycles of a 50 Hz alternating current).

Figure 2A:
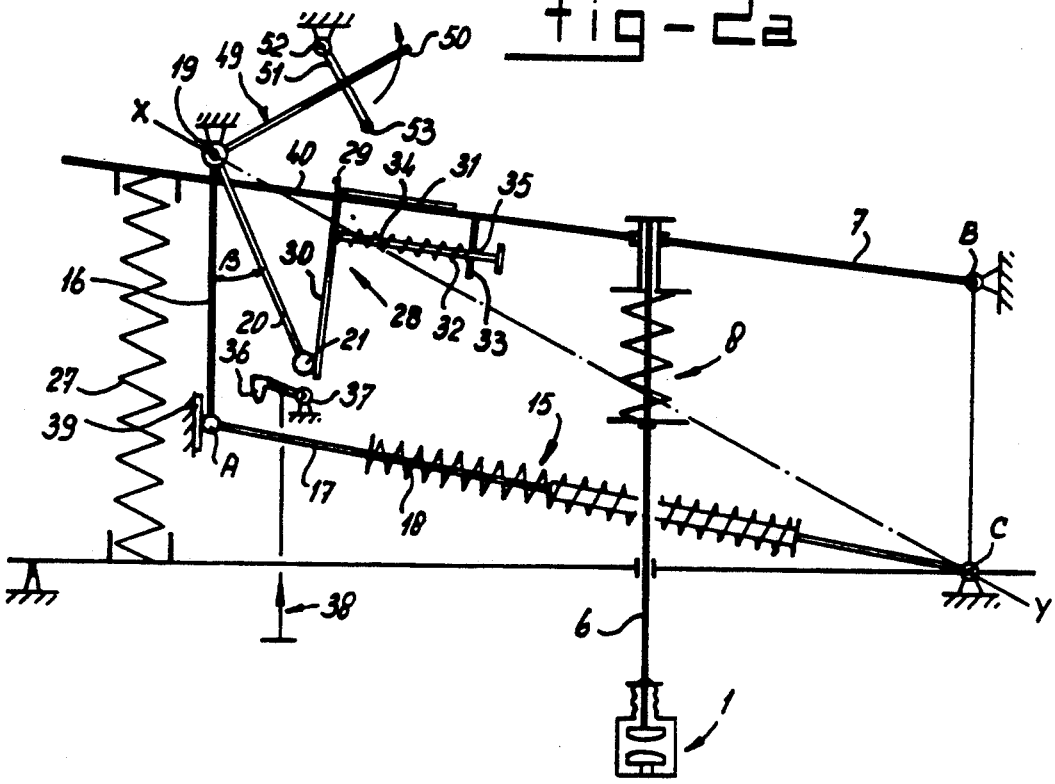
Figure 2B:
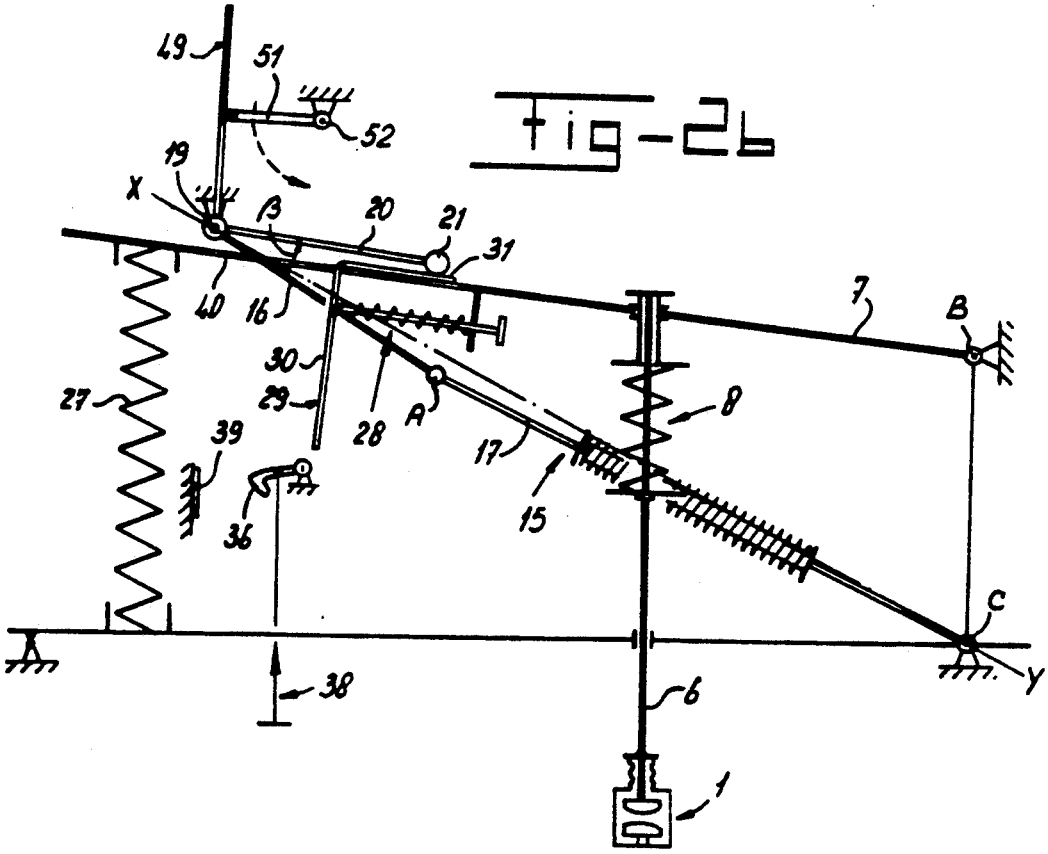

FIGS. 2*a*, 2*b* and 2*c* show an embodiment of a drive mechanism according to the invention, based on the known drive mechanism shown in FIGS. 1*a* and 1*b*, provided with a coupling mechanism 28.

In the embodiment shown, the coupling mechanism 28 comprises a slide 29 which can be moved in the lengthwise direction of the switching arm 7. The slide 29 is provided with a first stop 30, which extends essentially at right angles to the switching arm 7, and a second stop 31, which lies in line with the switching arm 7. The slide 29 is moved into the initial position shown in FIG. 2*a* by means of a mechanical compression spring 32, which acts on the one hand on the first stop 30 and, on the other, on a stop 33 connected to the switching arm 7. The spring 32 is supported by a guide rod 34, which is supported so that it can be guided in an opening 35 of the stop 33, with its free end blocked. The drive mechanism according to the invention then operates as follows.

Starting from the position shown in FIG. 2*a*, when the actuating shaft 19 is turned anticlockwise, the driving arm 20 is moved up with its free end 21 along the first stop 30 of the slide 29, and the tensioning mechanism 15 is also tensioned from the rest position shown in FIG. 2*a*. The spring 32 is consequently compressed, and the slide 29 is moved with its second stop 31 along the switching arm 7 in the direction of the pivot point B.

On further turning of the actuating shaft 19, the driving arm 20 will at a certain moment go past the first stop 30 of the slide 29 with its end, as a result of which the slide 29 is returned to its initial position, as shown in FIG. 2*a*, under the influence of the force of the compressed spring 32. The driving arm 20 in this case acts upon the second step 31 of the slide 29, as shown in FIG. 2*b*. The angle $\beta$ through which the driving arm 20 is displaced relative to the arm 16 of the tensioning mechanism 15 is selected such that in this situation the tensioning mechanism 15 has not yet passed the line X-Y.

Through then releasing the actuation of the actuating shaft 19, under the influence of the tensioning mechanism 15 the driving arm 20 will move the switching arm 7 downwards by means of its end 21 acting on the second stop 31 of the slide 29, with the result that the contacts 3, 4 of the switching unit 1 are closed by means of the linking overrun coupling 8 and the switching rod 6, all this in the same way as in the known drive mechanism shown in FIGS. 1*a* and 1*b*.

FIG. 2*c* shows the switching unit 1 in the driven state, in which the driving arm 20 is in engagement with its end 21 with the second stop 31 of the slide 29, and is held in this position by means of a locking pawl 36 which can pivot about a fixed pivot point 37 and acts upon the tensioning mechanism 15 in the pivot point A thereof. Through releasing of the locking by turning the locking pawl 36 clockwise, for example by means of a manually operable switch-off push-button 38, as shown schematically, the point A will move in the direction of a fixed stop 39, while the driving arm 20 moves with its end 21 past the second stop 31 of the slide 29, with the result that the switching arm 7, under the influence of the resetting force acting thereon, in this case the contact force compression spring 9 and the optional compression spring 27, strikes against the resetting stop 14, causing the contacts 3, 4 of the switching unit 1 to be separated.

Unlike the known drive mechanisms with a transition point or overturn mechanism, in the case of the improved drive mechanism according to the invention no rotation of the actuating shaft 19 anticlockwise (viewed in the figures) is needed for resetting the switching unit 1. By means of the coupling mechanism 28 according to the invention, the engagement of the tensioning mechanism 15 and the drive means, in this case the driving arm 20 and the switching arm 7, can take place without operation of the actuating means, in the example of an embodiment shown simply by releasing the locking by the locking pawl 36.

As can be seen from FIGS. 2*a*, 2*b* and 2*c*, the tensioning mechanism 15 can be a toggle mechanism because, unlike the known drive mechanism, it need not be moved past the line X-Y. Of course, the tensioning mechanism 15 can also be a transition point or overturn mechanism such as that used in the known drive mechanism, but with the difference that no movement through the transition point or dead centre past the line X-Y takes place. It will be clear that for tensioning of the transition point or toggle mechanism according to the invention less energy is always necessary than the maximum energy which can be stored in this tensioning mechanism, i.e. for taking it into its transition point or dead centre, as required in the known drive mechanism, but retaining the switching speed and other advantages of the known drive mechanism.

The coupling mechanism 28 essentially forms a movement-direction-dependent carrier mechanism, i.e. when the actuating shaft 19 is rotated in the anticlockwise direction, the switching arm 7 is not taken along, while on rotation of the actuating shaft 19 in the clockwise direction the switching arm 7 is driven or moved by means of the driving arm 20. These directions are of course interchangeable.

In the embodiment shown in FIGS. 2*a*, 2*b* and 2*c* the tensioning mechanism 15, the driving arm 20 coupled thereto and the switching arm 7 lie in one plane, while the switching arm 7 has an aperture 40 in which the arm 16 of the transition point or toggle mechanism and the driving arm 20 can move. As shown, this aperture 40 can be partially shut off by means of the second stop 31 of the slide 29, for engagement of the end 21 of the driving arm 20 thereon.

However, it is not always necessary for the tensioning mechanism 15, i.e. its arm 16, to be movable in the aperture 40. FIG. 3 shows schematically in perspective an embodiment of a three-phase electric circuit breaker or power switch, in which all three of the switching units 1, i.e. a separate switching unit for the respective phases R, S, T, are driven by means of a common tensioning mechanism 15. However, for each phase R, S, T, provision is made for drive means, in the form of a switching arm 7, driving arm 20 and coupling mechanism 28.

Figure 4A:
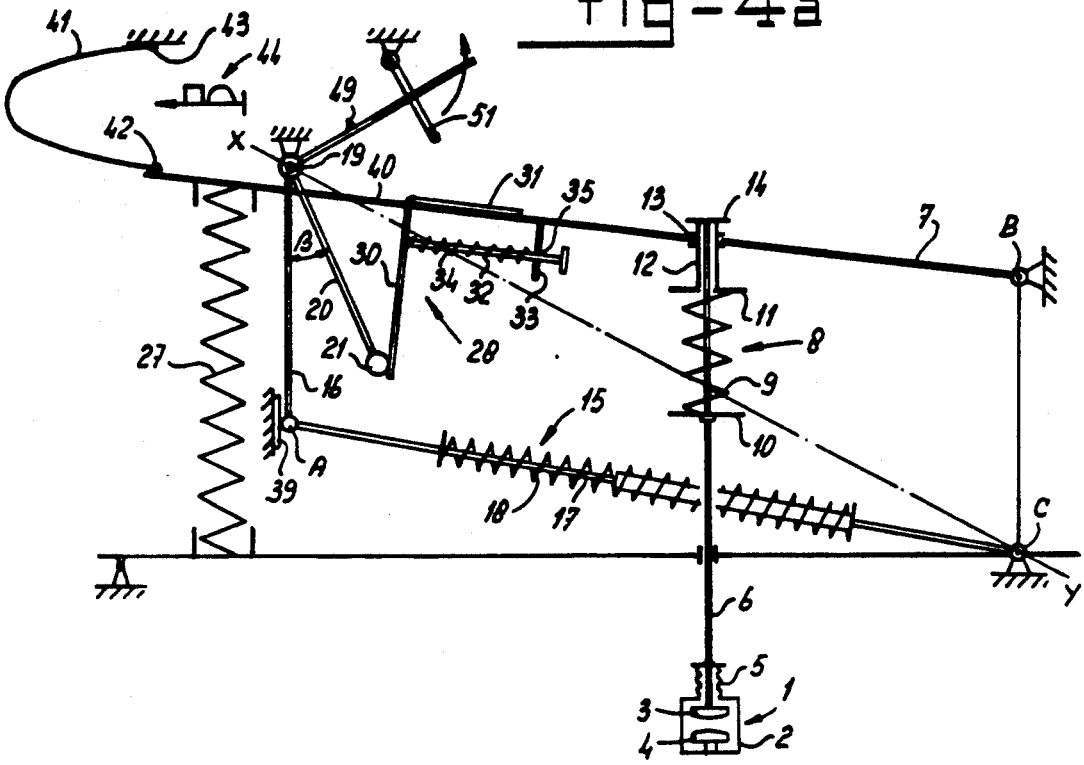
FIGS. 4*a* and 4*b* show, with an open switching unit and with a closed switching unit respectively, an embodiment of the drive mechanism according to the invention provided with a locking by means of a leaf spring.
Figure 4B:
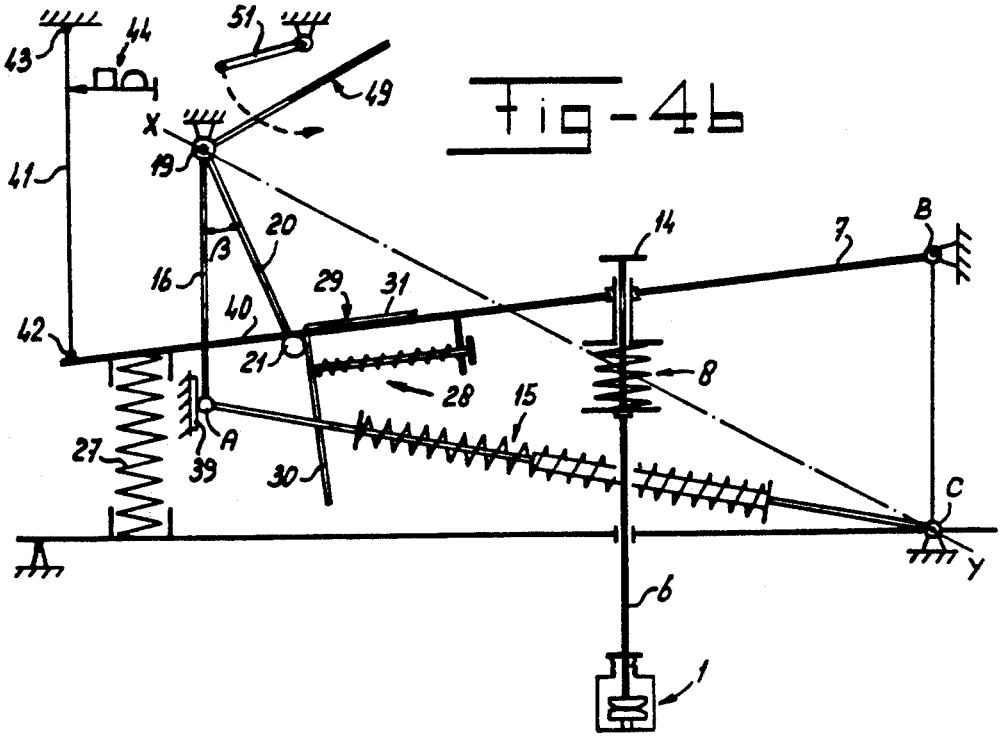

FIGS. 4*a* and 4*b* show the drive mechanism according to FIGS. 2*a*, 2*b* and 2*c*, but provided with locking means in the form of a leaf spring 41 which acts with one end 42 on the free end of the switching arm 7, and with its end 43 rests against a fixed point of the frame or the housing in which the switching unit 1 is fitted. In the non-driven state of the switching unit 1, shown in FIG. 4*a*, the leaf spring 41 is in the deflected position. In the driven state of the switching unit 1, shown in FIG. 4*b*, the leaf spring is in the extended position and resists the resetting force exerted on the switching arm 7 by means of the contact force compression spring 9 and the optional compression spring 27. The locking of the switching arm 7 can be released by making the leaf spring 41 deflect, and the switching arm 7 will return to the position shown in FIG. 4*a*, under the influence of the resetting force acting upon it. Note that the tensioning mechanism 15 from the position shown in FIG. 4*b* can be pretensioned according to FIG. 2*b*, but the switching arm 7 remains in the downward position.

A push-button 44, which can be actuated manually or by electromechanical and/or electrothermal means, can be provided in or near the centre of the leaf spring 41 for making the leaf spring 41 deflect, as indicated schematically by a short dash (manual operation), a semi-circle (electromagnetic operation) and a square (electrothermal operation) respectively. It is pointed out that the locking pawl 36 according to the embodiment shown in FIGS. 2*a*, 2*b* and 2*c* can also be unlocked by electromagnetic or electrothermal means.

In order to improve the resetting of the switching unit 1 at a stroke, the switching arm 7 is adapted in design, as shown schematically in FIG. 5. At the position of the action of the switching arm 7 upon the resetting stop 14, the mass of the switching arm 7 is increased by means of a block-shaped anvil element 45 fixed thereon. The resetting stop 14 is in the form of a block 46 with a V-shaped cross-section, which is fixed or detachably connected, for example by means of a screw thread connection, to the switching rod, the tapering end 47 of the V pointing in the direction of the anvil 45. This means that a linear linewise engagement of the anvil 45 and the block 46 can be achieved, with the result that a definite "hammering" of the anvil mass 45 on the block 46 takes place, irrespective of the rotational position of the switching arm 7 relative to the block 46. The anvil 45 is preferably hardened at the side where the resetting stop, such as the block 46, acts upon it. The anvil 45 is provided with an aperture 48, through which the switching rod 6 can slide.

Through increasing the mass of the switching arm 7 at the collision or action point with the resetting stop, a relative reinforcement of the switching arm 7 is achieved, which means that it deforms less under the influence of the collision energy, with the result that a greater part of the collision energy is transmitted to the switching rod 6 for opening at a stroke of the contacts 34 of the switching unit 1. Selectively increasing the mass of the switching arm 7 in this way means that an increase in the hammer stroke effect by a factor of 3 can be achieved.

The remainder of the switching arm 7 can itself be made lightweight, of course adequate for withstanding the forces exerted on it, so that the influence on the switching speed by the local mass increase of the switching arm 7 is very small or negligible.

In order to be able to meet the need for control of the switch by rotating the actuating means in one direction, provision is made for a tensioning arm 49, coupled to the actuating shaft 19 and having a stop 50 and a control arm 51 which can engage thereon and is pivoted on a fixed point 52 (see FIGS. 2*a*, 2*b* and 2*c*).

If the control arm 51 is rotated in the anticlockwise direction in FIG. 2*a*, it comes into contact with its end 53 with the stop 50 of the tensioning arm 49, as a result of which the actuating shaft 19 is rotated and the tensioning mechanism 15 is consequently tensioned. In the position shown in FIG. 2*b*, in which the end 21 of the driving arm 20 is acting on the second stop 31 of the slide 29, the end 53 of the control arm 51 is only just touching the stop 50 of the tensioning arm 49. When the control arm 51 is rotated further in the anticlockwise direction, the engagement on the tensioning arm 49 is released, following which the actuating shaft 19 under the influence of the tensioning mechanism 15 is turned in the clockwise direction, for driving the switching unit 1, as discussed above.

In the embodiment shown, the tensioning arm 49 has an aperture 54 through which the control arm 51 can move. Unlike the known drive mechanism, the control of one or more switching units can be achieved with the provision of a drive mechanism according to the invention by rotating the control arm 51 or a control crank or wheel in one and the same direction.

Figure 6B:
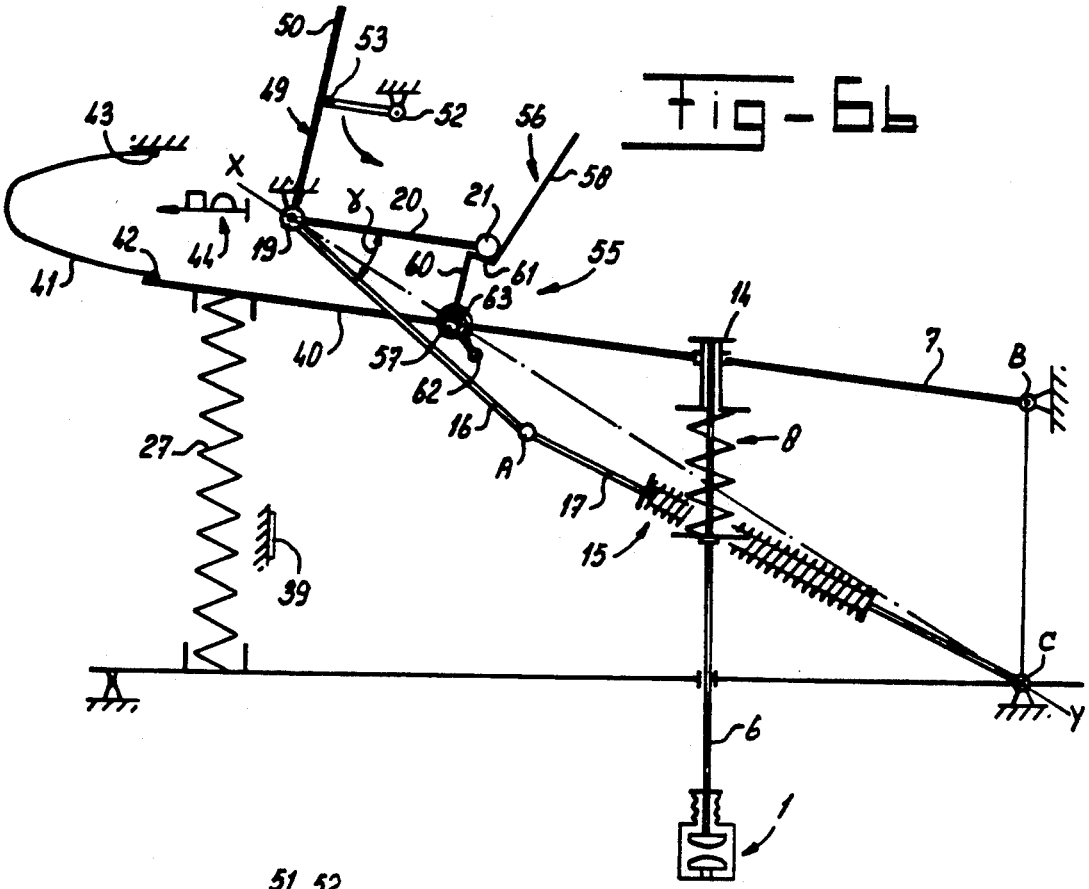
Figure 6C:
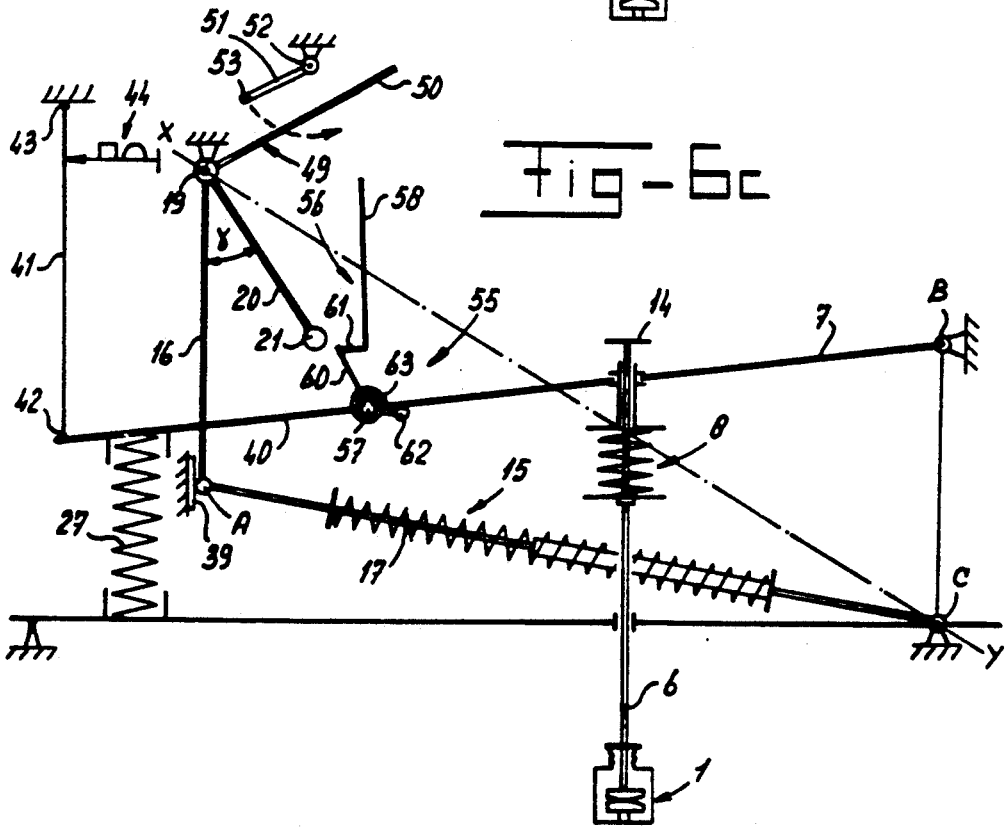

FIGS. 6*a*, 6*b* and 6*c* show the preferred embodiment of the drive mechanism according to the invention, also based on the known drive mechanism shown in FIGS. 1*a* and 1*b*, and provided with a coupling mechanism 55.

In the embodiment shown, the coupling mechanism 55 comprises an approximately L-shaped coupling arm 56 which is fixed to the switching arm 7 so that it can rotate in the plane of the drawing. The long leg 58 of the coupling arm 56 extends here to one side of the switching arm 7 in the resetting direction of the switching unit 1, while the short leg 59 lies at the other side of the switching arm 7, as shown.

The long leg 58 is provided with a step, formed by a first stop 60 extending from the pivot point 57 and a second stop 61, as shown. In the pivot point 57, a coil spring 63 acts upon the coupling arm 56, such that, viewed in the plane of the drawing, a mechanical presetting force acting in the anticlockwise direction is exerted on the coupling arm 56. The rotation of the coupling arm 56 is limited to the position in which the end 62 of the short leg 59 touches the switching arm 7. Instead of a coil spring 63, other means can also be used, for example a mechanical tension spring (not shown) operating between the short leg 59 and the switching arm 7. The remaining parts of the drive mechanism correspond, as discussed with reference to FIGS. 2 to 5. The manner in which this preferred embodiment of the drive mechanism according to the invention operates is now as follows.

Starting from the position shown in FIG. 6*a*, in which the contacts 3, 4 of the switching unit 1 are open, when the actuating shaft 19 is rotated anticlockwise by means of the control arm 51 and the tensioning arm 49, the driving arm 20 will come into contact with its free end 21 with the first stop 60 of the coupling arm 56, with the result that the latter will be rotated in the direction towards the pivot point B, in the figure in the clockwise direction, against the force of the coil spring 63.

On further rotation of the actuating shaft 19, the end 21 of the driving arm 20 will move past the first stop 60 of the coupling arm 56, as shown in FIG. 6*b*. In the position shown in FIG. 6*b*, the end 53 of the control arm 51 is just touching the stop 50 of the tensioning arm 49. On further rotation of the control arm 51, or the actuating shaft 19, in the anticlockwise direction, the engagement on the tensioning arm 49 is released. The angle $\gamma$ through which the driving arm 20 is displaced relative to the arm 16 of the tensioning mechanism 15 is selected such that in this situation the tensioning mechanism 15 has not yet passed the line X-Y, and the actuating shaft 19 is rotated by means of the tensioning mechanism 15 in the clockwise direction.

Since the end 21 of the driving arm 20 is now resting against the second stop 61 of the coupling arm 56, as shown in FIG. 6*b*, the switching arm 7 is moved downwards through the movement of the driving arm 20, as a result of which the contacts 3, 4 of the switching unit 1 are closed by means of the linking overrun coupling 8 and the switching rod 6, all this in the same manner as discussed above.

FIG. 6*c* shows the switching unit 1 in the driven state, in which as a result of the limited rotation of the coupling arm 56 the end 21 of the driving arm 20 no longer acts upon the second stop 61 of the coupling arm 56. The switching arm 7 is held in the driven state by means of the leaf spring 41, as discussed with reference to FIGS. 4*a*, 4*b*. The locking of the switching arm 7 can be released very rapidly by making the leaf spring 41 deflect, and under the influence of the resetting force exerted thereon by the contact force compression spring 9 and the optional compression spring 27 it will return to the position shown in FIG. 6*a*.

The coupling mechanism 55 again forms a movement-direction-dependent carrier mechanism, in which when the actuating shaft 19 rotates in one direction (by means of the actuating means 51) the switching arm 7 is not driven and when the actuating shaft 19 rotates in the other direction (by means of the tensioning mechanism 15) the switching arm 7 is driven.

It is pointed out that in the driven state of the switching unit 1, as shown in FIG. 6*c*, the tensioning mechanism 15 can already be tensioned as in the situation shown in FIG. 6*b*, with the result that immediately after the resetting of the switching unit 1 it can be switched on again. It will be clear that the measures discussed in FIG. 5 concerning the improvement of the resetting of the switching unit 1 can be applied with the same advantage in the embodiment of the invention according to FIGS. 6*a*, 6*b* and 6*c*. If desired, the coupling arm can also comprise two separate legs 58, 59 attached to each other, or means other than the short leg 59 for limiting the rotation of the coupling arm 56, in this case the long leg 58, can be used. Instead of the leaf spring 41, a locking of the switching arm 7 by means of a locking pawl 24 (FIGS. 1*a*, 1*b*) or a locking of the tensioning mechanism 15 by means of a locking pawl 36 (FIGS. 2*a*, 2*b*, 2*c*) can also be used, in which case in the driven state of the switching unit 1 the end 21 of the driving arm 20 remains in contact with the second stop 61 of the coupling arm 55.

Although the invention has been discussed with reference to examples of embodiments of a coupling mechanism in the form of a slide or coupling arm, for a person skilled in the art it will be clear that such a coupling mechanism can be designed in various ways in the form of a movement-direction-dependent carrier mechanism. Of course, instead of the locking means shown, the locking pawls used in the known drive mechanism can also be used, in which case the unlocking lever 22 can be replaced by a manually, electromagnetically or electrothermally operated switch-off device, as illustrated for the drive mechanism according to the invention.

We claim:

1. A drive mechanism for an electric switch made up of at least one switching unit, comprising a biasing mechanism in the form of a transition point or overturn mechanism which can act upon the at least one switching unit, actuating means for tensioning the biasing mechanism, drive means for driving the at least one switching unit under the influence of the energy stored in the biasing mechanism, means for resetting the at least one switching unit from a driven state, and a coupling mechanism for coupling the biasing mechanism in a biased state thereof with the drive means, for driving the at least one switching unit, and for releasing the coupling of the biasing mechanism and the drive means when the at least one switching unit is in the driven state, wherein the coupling mechanism is designed to bias the biasing mechanism by the actuating means from a rest position to a position before the transition point or dead center thereof, and the drive means and the coupling mechanism form a movement-direction-dependent carrier mechanism, such that the biasing mechanism and the drive means act upon each other only in a direction of movement opposite to a direction in which the biasing mechanism operates, for driving the at least one switching unit.

2. A drive mechanism according to claim 1, in which the biasing mechanism is a mechanism that stores and releases energy at only one side of a dead center point of the mechanism.

3. A drive mechanism according to claim 1, in which the drive means comprise at least one switching arm acting on the at least one switching unit and a driving arm coupled to the biasing mechanism, while the coupling mechanism is made up of a coupling arm fixed to the switching arm and rotatable in a plane of the switching arm and the driving arm, and provided with a first and second stop and spring means for moving the coupling arm into an initial position, the first stop is arranged such that, on biasing of the biasing mechanism from a rest position by the actuating means, the driving arm acts upon the first stop, as a result of which the coupling arm is rotated from an initial position relative to the switching arm and loads the spring means, and that in the vicinity of the transition point or dead center of the biasing mechanism the driving arm moves past the first stop of the coupling arm and acts upon the second stop of the spring-loaded coupling arm, which second stop is arranged such that on the return of the biasing mechanism in a direction towards the rest position of the switching arm is driven by means of the driving arm acting on the second stop of the coupling arm.

4. A drive mechanism according to claim 3, in which the coupling arm is essentially L-shaped, with a long leg extending at one side of the switching arm in a direction opposite to a direction in which the switching unit is driven, and a shorter leg extending at another side of the switching arm, for limiting in an initial position of the rotation of the coupling arm caused by the spring means, the longer leg being provided with a step, and the part of the longer leg extending from a point where the coupling arm is fixed to the switching arm till the step forming the first stop, while the step lying at right angles thereto forms the second stop of the coupling arm.

5. A drive mechanism according to claim 3, in which the biasing mechanism, the driving arm coupled thereto and the switching arm lie in one plane, while the switching arm has an aperture in which the biasing mechanism and the driving arm can move.

6. A drive mechanism according to claim 3, in which provision is made for locking means acting on the biasing mechanism, for locking the biasing mechanism before the rest position when the switching arm is being driven, while the driving arm remains in engagement with the second step of the coupling arm, and through releasing the locking of the driving arm can move past the second stop of the coupling arm, and under the influence of a resetting force acting upon it, the switching arm can be reset in a direction opposite to the driving direction.

7. A drive mechanism according to claim 6, provided with switch-off means acting upon the locking means, for selective timed releasing of the locking means by electromechanical and/or electrothermal means.

8. A drive mechanism according to claim 3, provided with locking means acting on the switching arm, for locking the switching arm in the driven state, in which the biasing mechanism is in the rest position and the driving arm has been moved past the second stop of the coupling mechanism, and where through releasing the locking means, under the influence of the resetting force acting thereon, the switching arm can be reset in a direction opposite to the driving direction.

9. A drive mechanism according to claim 8, provided with switch-off means acting upon the locking means, for selective timed releasing of the locking means by electromechanical and/or electrothermal means.

10. A drive mechanism according to claim 8, in which the locking means comprise a leaf spring extending essentially at right angles to the switching arm, and firmly supported at one end, and another end thereof acting on the switching arm.

11. A drive mechanism according to claim 1, in which the drive means comprise at least one switching arm acting on the at least one switching unit and a driving arm coupled to the biasing mechanism, while the coupling mechanism is made up of a slide which is movable in a lengthwise direction of the switching arm, and is provided with a first and second stop and spring means for moving the slide into an initial position, while the first stop is arranged such that on biasing of the biasing mechanism from the rest position by the actuating means, the driving arm is moved from its initial position in the lengthwise direction of the switching arm and loading the spring means, and that in the vicinity of the transition point or dead center of the biasing mechanism the driving arm moves past the first stop of the slide, as a result of which it returns to its initial position under the influence of the spring force of the spring means, while the driving arm acts upon the second stop of the slide, which second stop is arranged such that on the return of the biasing mechanism in the direction towards the rest position of the switching arm is driven by means of the driving arm acting on the second stop of the slide.

12. A drive mechanism according to claim 11, in which the slide is made up of a first leg extending essentially at right angles to the switching arm in the driving direction of the switching unit, and a second leg extending parallel to the switching arm, with blocking means acting on the slide, for limiting in the initial position the movement of the slide caused by the spring means, while the first leg forms the first stop and the second leg forms the second stop of the slide.

13. A drive mechanism according to claim 11, in which the biasing mechanism, the driving arm coupled thereto and the switching arm lie in one plane, while the switching arm has an aperture in which the biasing mechanism and the driving arm can move.

14. A drive mechanism according to claim 11, in which provision made for locking means acting on the biasing mechanism, for locking the biasing mechanism before the rest position when the switching arm is being driven, while the driving arm remains in engagement with the second stop of the slide, and through releasing the locking means the driving arm can move past the second stop of the slide, and under the influence of a resetting force acting upon it the switching arm can be reset in a direction opposite to the driving direction.

15. A drive mechanism according to claim 14, provided with switch-off means acting upon the locking means, for selective timed releasing of the locking means by electromechanical and/or electrothermal means.

16. A drive mechanism according to claim 11, provided with locking means acting on the switching arm, for locking the switching arm in the driven state, in which the biasing mechanism is in the rest position and the driving arm has been moved past the second stop of the coupling mechanism, and where through releasing the locking means, under the influence of the resetting force acting thereon, the switching arm can be reset in a direction opposite to the driving direction.

17. A drive mechanism according to claim 16, provided with switch-off means acting upon the locking means, for selective timed releasing of the locking means by electromechanical and/or electrothermal means.

18. A drive mechanism according to claim 16, in which the locking means comprise a leaf spring extending essentially at right angles to the switching arm, and firmly supported at one end, and another end thereof acting on the switching arm.

19. A drive mechanism according to claim 1, in which the actuating means comprise a pivoting biasing arm coupled to the biasing mechanism, and provided with a stop and a rotatably mounted control arm which can act upon said stop, while for biasing of the biasing mechanism the control arm can act upon the stop of the biasing arm, and in the vicinity of the transition point or dead center of the biasing mechanism the control arm can move past the stop of the biasing arm, such that the biasing mechanism can move from its biased position in the direction of its rest position.

20. A drive mechanism according to claim 19, in which the biasing arm has an aperture in which the control arm can move, and in which the stop is formed by the free end of the biasing arm extending from the aperture.

21. A hammer mechanism according to claim 1, comprising a switching arm for driving the at least one switching unit, in which the switching arm from the driven state can act upon a resetting stop for resetting the at least one switching unit only after traveling free, wherein a mass of the switching arm is increased in a vicinity of an action point of the switching arm and the resetting stop.

22. A hammer mechanism, for use in a drive mechanism for an electric switch provided with at least one switching unit, comprising a switching arm for driving the at least one switching unit, in which the switching arm from a driven state can act upon a resetting stop for resetting the at least one switching unit only after traveling a certain distance, the resetting stop is in the form of a block with an approximately v-shaped cross-section, of which a tapering end froms a linear engagement with the switching arm, wherein a mass of the switching arm is increased in a vicinity of an action point of the switching arm and the resetting stop.

23. A hammer mechanism according to claim 22, in which the switching arm is provided with an anvil element at a side where it can act upon the resetting stop, for increasing the mass of the switching arm.

24. A hammer mechanism according to claim 22, in which the switching arm can engage by means of a linking overrun coupling on a switching rod coupled to at least one switching unit for driving it, while the resetting stop is connected to the switching rod and the overrun coupling comprises a contact force spring connected to the switching rod, such that the switching arm is free from the resetting stop when the switching rod is being driven, while the switching arm and the resetting stop act upon each other along a line when resetting the at least one switching unit.

25. A single-phase or polyphase electric circuit breaker or power switch provided with at least one switching unit, comprising a biasing mechanism in the form of a transition point or overturn mechanism which can act upon the at least one switching unit, actuating means for biasing the biasing mechanism, drive means, for driving the at least one switching unit under the influence of the energy stored in the biasing mechanism, means for resetting the at least one switching unit from the driven state, and a coupling mechanism for coupling the biasing mechanism in its biased state with the drive means, for driving the at least one switching unit, and for releasing the coupling of the biasing mechanism and the drive means when the at least one switching unit is in the driven state, wherein the coupling mechanism is designed to bias the biasing mechanism by the actuating means from a rest position to before a transition point or dead center position, and the drive means and the coupling mechanism form a movement-direction-dependent carrier mechanism, such that the biasing mechanism and the drive means act upon each other only in a direction of movement opposite to a biasing direction, for driving the at least one switching unit.

* * * * *